US007162821B2

(12) United States Patent
Venkataraman et al.

(10) Patent No.: US 7,162,821 B2
(45) Date of Patent: Jan. 16, 2007

(54) ILLUMINATED SIGN

(75) Inventors: Ravi Venkataraman, Cookeville, TN (US); Todd William Meeks, Kings Mountain, KY (US)

(73) Assignee: Identity Group, Inc., Cookeville, TN (US)

( * ) Notice: Subject to any disclaimer, the term of this patent is extended or adjusted under 35 U.S.C. 154(b) by 0 days.

(21) Appl. No.: 10/601,176

(22) Filed: Jun. 20, 2003

(65) Prior Publication Data

US 2004/0255497 A1 Dec. 23, 2004

(51) Int. Cl.
*G09F 13/00* (2006.01)

(52) U.S. Cl. ..... 40/541; 40/552; 40/580

(58) Field of Classification Search ..... 40/544, 40/541, 550, 579, 580
See application file for complete search history.

(56) References Cited

U.S. PATENT DOCUMENTS

| | | | | |
|---|---|---|---|---|
| 2,157,772 | A * | 5/1939 | McCann et al. | 40/546 |
| 2,262,930 | A | 11/1941 | Gasper | |
| 2,810,225 | A | 10/1957 | Hardesty | |
| 3,884,559 | A | 5/1975 | Baba | |
| 3,968,584 | A | 7/1976 | Kingston | |
| 4,373,283 | A | 2/1983 | Swartz | |
| 4,767,477 | A | 8/1988 | Danjell | |
| 4,777,749 | A | 10/1988 | Leo, Sr. | |
| 4,796,170 | A * | 1/1989 | Pedersen et al. | 362/308 |
| 4,862,616 | A | 9/1989 | Honeycutt | |
| 4,967,317 | A * | 10/1990 | Plumly | 362/613 |
| 4,976,057 | A | 12/1990 | Bianchi | |
| 5,009,019 | A | 4/1991 | Erlendsson et al. | |
| 5,414,947 | A | 5/1995 | Hjaltason | |
| 5,536,558 | A | 7/1996 | Shelton | |
| 5,682,697 | A | 11/1997 | Hjaltason | |
| 5,829,177 | A | 11/1998 | Hjaltason | |
| 6,009,650 | A | 1/2000 | Lamparter | |
| 6,131,322 | A | 10/2000 | Hjaltason | |
| 6,205,691 | B1 * | 3/2001 | Urda et al. | 40/559 |
| 6,240,664 | B1 | 6/2001 | Hjaltason | |
| 6,361,186 | B1 | 3/2002 | Slayden | |
| 6,404,131 | B1 | 6/2002 | Kawano et al. | |
| 2002/0011016 | A1 | 1/2002 | Aeling et al. | |
| 2002/0043012 | A1 | 4/2002 | Shibata et al. | |

FOREIGN PATENT DOCUMENTS

| | | |
|---|---|---|
| EP | 0341817 | 11/1989 |
| GB | 1585392 | 3/1981 |
| JP | 9298007 A2 | 11/1997 |
| JP | 11219138 A2 | 8/1999 |
| JP | 2000164018 A2 | 6/2000 |

(Continued)

*Primary Examiner*—Cassandra Davis
(74) *Attorney, Agent, or Firm*—Reed Smith LLP

(57) ABSTRACT

An illuminated sign or nametag achieving the even glow and brightness of neon light displays without neon light tubes. Each character or symbol of the sign or nametag contains a plurality of light emitting members. Each such indicia comprises a light diffusion layer illuminated by light emitting members disposed on, near or in the light diffusion layer. A permanent or temporary masking layer partially covers the light diffusion layer to form a glowing border around the masking layer. Reflective layers covering either or both faces of the light diffusion layer may be used to intensify the light emitted therefrom. By the particular arrangement of the reflective surfaces relative to the light diffusion layer, electromagnetic radiation in the form of visible light from the light emitting members is controlled to provide an aura that enhances formed outlines or contours of light around the indicia making up the sign.

22 Claims, 7 Drawing Sheets

FOREIGN PATENT DOCUMENTS

WO WO99/03086 1/1999

WO WO02/089101 11/2002

* cited by examiner

ILLUMINATED SIGN

FIELD OF THE INVENTION

The present invention relates generally to illuminated signs or nametags which achieve the even glow and brightness of neon light displays without neon light tubes. More particularly, the present invention relates to an illuminated sign or nametag where each symbol and/or alphanumeric character contains its own internal light source.

BACKGROUND OF THE INVENTION

Active electrical lighting using neon tubes became popular in the 1920's and developed into a "pop" art form in the United States. Neon lighting became widely used for advertising and sign display. Its brightness and variable color could be relied upon to attract attention. However there are now a number of disadvantages associated with active electrical neon lighting. Such active electrical lighting has fallen out of favor and is banned or closely controlled by zoning and sign ordinances in many towns, municipalities and cities. Second, there are limitations on the complexity of alphanumeric and graphic sign displays inherent in using neon tubes. Neon tubes place a limitation on the configurations that can be achieved. Finally, an active electrical power supply is always required to cause light discharge from the neon gas confined in the tubes.

Existing neon-like display devices are overly complicated in design and, as a result, time-consuming and expensive to manufacture. Moreover, the light source in such neon-like displays has conventionally been spaced-apart from the face-plate of the display thereby limiting the design options of such devices. For example, original works of art, such as company logos, are not readily reproducible on conventional neon-like displays. Further, the light energy in conventional displays is not utilized with great efficiency. As a result, such conventional neon-like displays consume excess power and are costly to use.

It would be desirable, therefore, to provide a display device capable of producing the even glow and brightness of neon light that is efficient in design and easy to manufacture.

It would also be desirable to provide a display device capable of producing the even glow and brightness of neon light in which the light source is adjacent to or disposed within one of the components making up the indicia to be illuminated in the display, thereby expanding the design options for such devices.

It is further desirable to provide a display device capable of producing the even glow and brightness of neon light which efficiently utilizes light energy and is therefore less expensive to operate.

It is also desirable to provide a display device capable of producing the even glow and brightness of neon light on which original works of art and/or company logos can be more accurately reproduced.

SUMMARY OF THE INVENTION

Accordingly, the present invention provides an illuminated sign or nametag achieving the even glow and brightness of neon light displays without neon light tubes. Each character or symbol of the sign or nametag contains a plurality of light emitting members. Each such indicia comprises a light diffusion layer in which the light emitting members are at least partially received. A masking layer partially covers the light diffusion layer to form a glowing border, of a uniform or irregular width, around the masking layer. Reflective layers covering either or both faces of the light diffusion layer may be used to intensify the light emitted therefrom. By the particular arrangement of the reflective surfaces relative to the light diffusion layer, electromagnetic radiation in the form of visible light from the light emitting members is controlled to provide an aura that enhances formed outlines or contours of light around the indicia making up the sign.

In another aspect of the present invention, a sign or nametag is provided having a translucent light diffusion layer, the front face of which defines least one character or symbol in raised relief with respect to a substantially planar portion of the front face. A plurality of light emitting members are at least partially disposed within the light diffusion layer and an opaque masking layer covers at least part of the substantially planar portion of front face of the light diffusion layer.

In either aspect of the present invention, original works of art, including logos, may be easily and accurately reproduced on the display where energy efficient light emitting diodes are preferably employed as light sources.

Other features and benefits of the present invention will become apparent from the detailed description with the accompanying figures contained hereinafter.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, other elements that may be well known. Those of ordinary skill in the art will recognize that other elements are desirable and/or required in order to implement the present invention. However, because such elements are well known in the art, and because they do not facilitate a better understanding of the present invention, a discussion of such elements is not provided herein. The detailed description of the present invention and the preferred embodiment(s) thereof is set forth in detail below with reference to the attached drawings.

Figure 1:
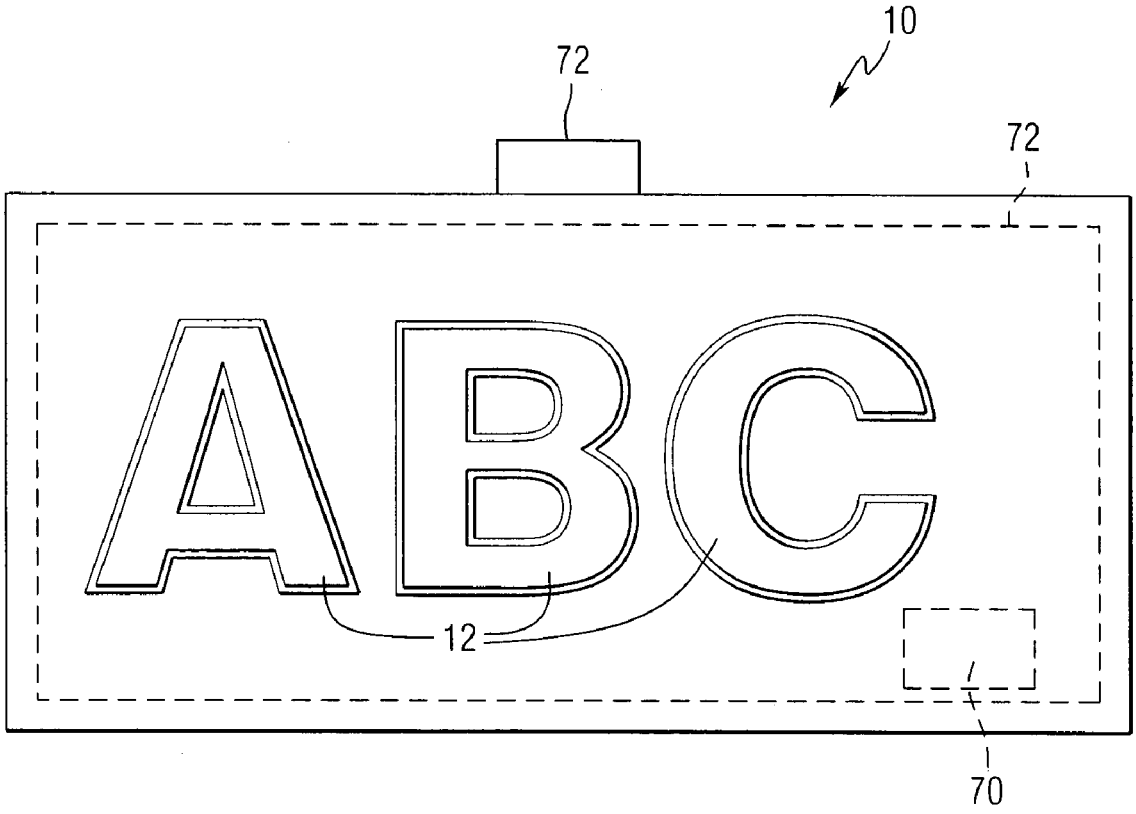
FIG. 1 is a front plan view of a first preferred embodiment of a sign in accordance with the present invention.
Figure 2:
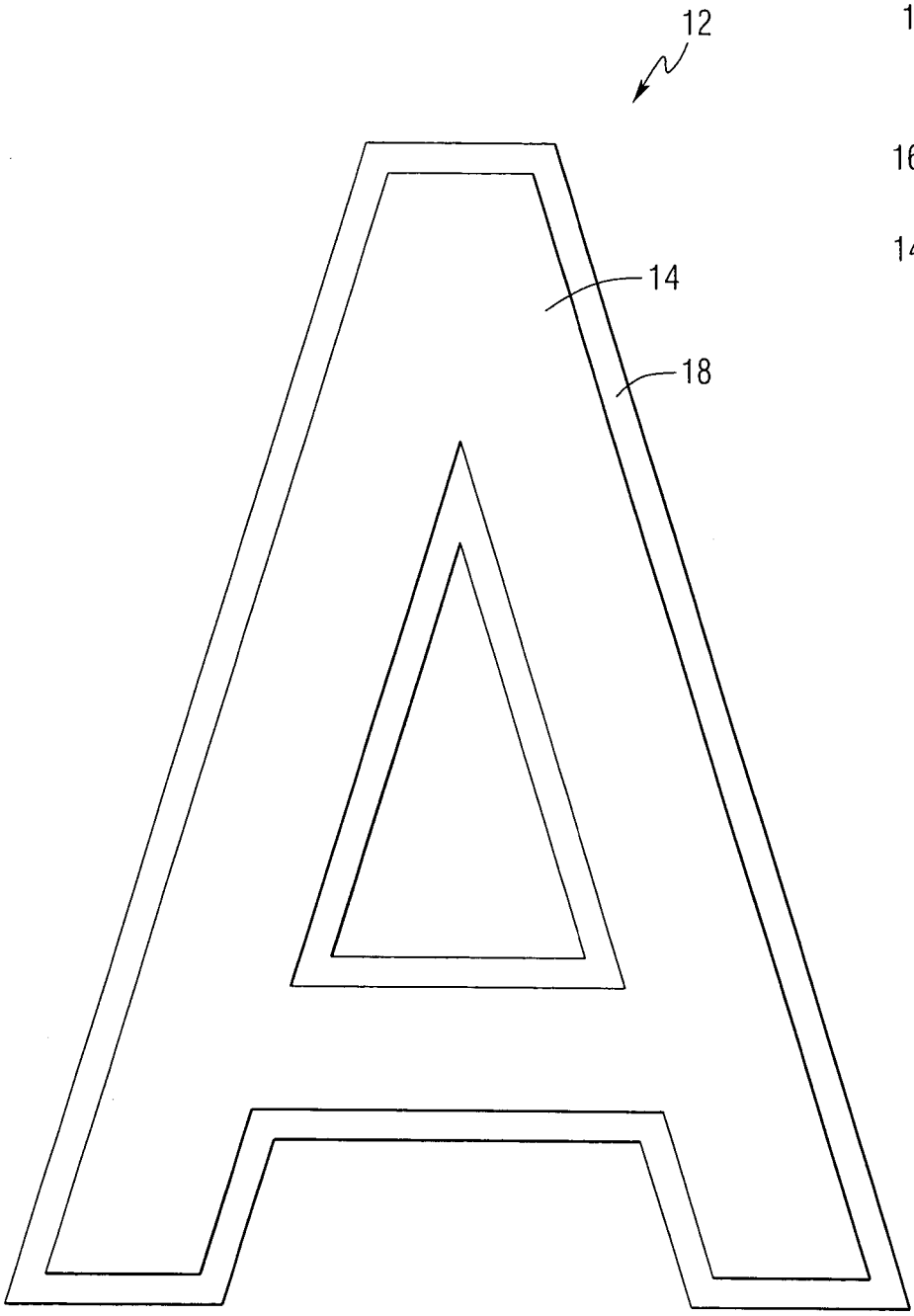
FIG. 2 is a front plan view of one of the characters of the sign of FIG. 1.
Figure 3:
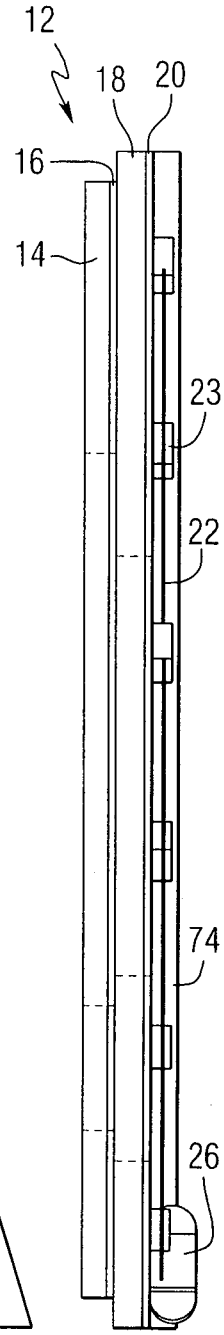
FIG. 3 is a side view of the character of FIG. 2.
Figure 4:
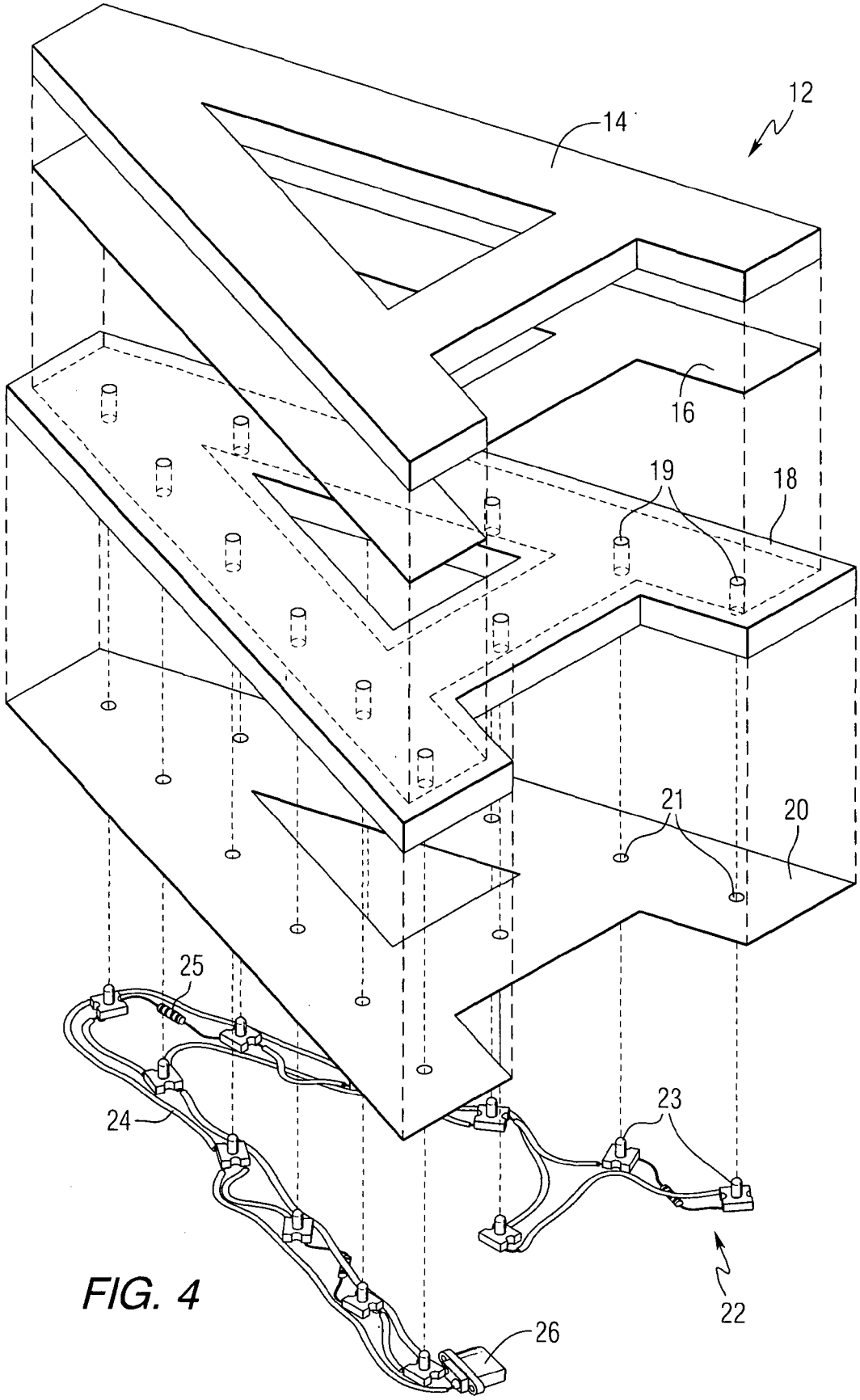
FIG. 4 is an exploded perspective view of the character of FIG. 2.
Figure 5:
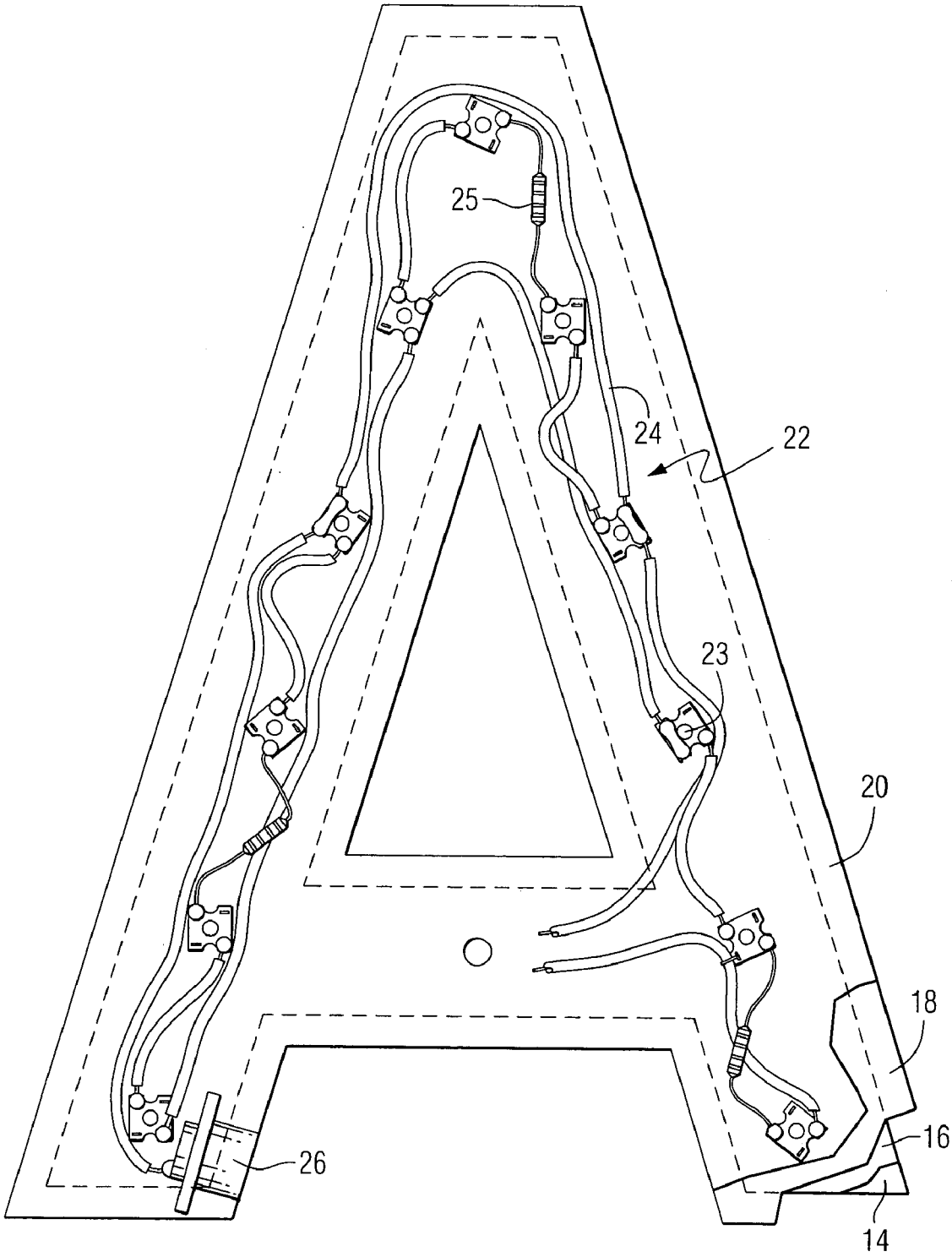
FIG. 5 is a rear plan view of the character of FIG. 2 having a portion cut away.

Referring now to the drawings, FIG. 1 shows a first preferred embodiment of a sign 10 of the present invention comprising a plurality of characters/symbols 12, in this case being the letters spelling out the letters "ABC". As shown in FIGS. 2–4, each of the characters 12 of the present invention preferably comprises a masking layer 14 and a light diffusion layer 18. A first reflective layer 16 is disposed between the masking layer 14 and the light diffusion layer 18. The reflective layer 16 may completely or only partially cover the rear face of the masking layer 14. A second reflective layer 20 may be disposed on the underside of the light diffusion layer 18. The reflective layer 20 may completely or only partially cover the rear face of the diffusion layer 18.

The letters "ABC" on the front face of the illuminated sign 10 is representative of information that is intended for visual communication when the sign 10 is installed and illuminated. In addition to letters, such indicia or communication matter also might include figures, ornaments, legends, and the like.

It should be noted that the layers 14, 16, 18 and 20 in FIGS. 2–4 are drawn with enlarged cross sections for purposes of illustration only, and the drawings of the layers are not representative of the relative thickness of the layers. The layers in fact may be only a film, but to understand the drawings, the layers are blown up in cross section for ease of illustration.

The light diffusion layer 18 defines a plurality of cavities 19 for receiving therein the light emitting members 23 of the means for lighting 22. As shown in FIG. 3, the means for lighting comprises a circuit of a plurality of light emitting members 23 connected by wires 24 and resistors 25, where required, and a power source connector 26. Alternatively, the means for lighting 22 may comprise printed circuit boards (PCBs) having the light emitting members 23 attached to the PCBs, including flexible PCBs and PCBs having a reflective surface acting as the reflective layer 16.

Preferably, the sign 10 is DC-powered and thus may also include a transformer for converting AC to DC. Alternatively, the sign 10 may be powered by a battery 70 that supplies the direct current for powering each of the light emitting members 23. The present invention also encompasses sizing the sign 10 so that it may be worn as a nametag or to provide other useful information. In such case, the sign 10 may also comprise means for donning such as an adhesive strip 72 or a clip, a spring-loaded clip, a magnetic clip, string, pin, rivet, snap button, etc.

The sign 10 of the present invention creates a light effect similar to neon signs in that a glowing contour with aura occurs around the characters/symbols 12 of the sign 10. An important aspect of this invention is the ability to control and guide light rays in accordance with the teachings herein to achieve certain pleasant third dimensional and/or colorful effects with a minimum of materials.

Colors to achieve special effects may be selected in any desired combination in the masking layer 14, the reflective layers 16 and 20, the diffusion layer 18 and/or in the light emitting members 23. In this connection, it is known that a color of light may be used in confrontation with another color of light to effectively cancel, amplify, or modify the resulting color, depending on the color selections and intensity. This technique may be used effectively in the structure of this invention.

The interior of the sign 10 which houses the light emitting means 22 may preferably be encased in a curable polymer compound 74 in order to protect the light emitting means 22 from moisture, heat and to make the sign 10 durable by reducing the potential for developing loose connections at a later date.

Light Emitting Members

Preferably, the light emitting members 23 consist of light emitting diodes (LEDs: rectifying semi-conductor devices that convert electrical energy into electromagnetic radiation), but may also preferably consist of any kind of light, such as incandescent, fluorescent, ultraviolet, cold cathode ray tubes and electroluminescence (the application of an electric field to a material, usually solid, such as a fluorescent plastic plate) sized to fit within the cavities 19. The LEDs employed as the preferred light emitting members 23 may comprise square-bodied or elliptically shaped LEDs.

Figure 6:
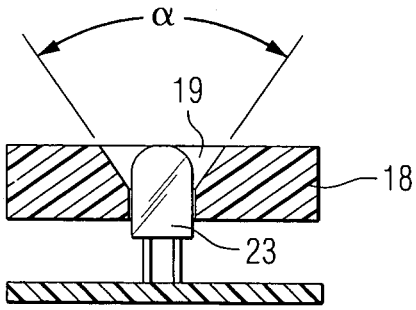
FIG. 6 is a side plan view of one of the light emitting members disposed in a cavity within the character of FIG. 2.
Figure 7:
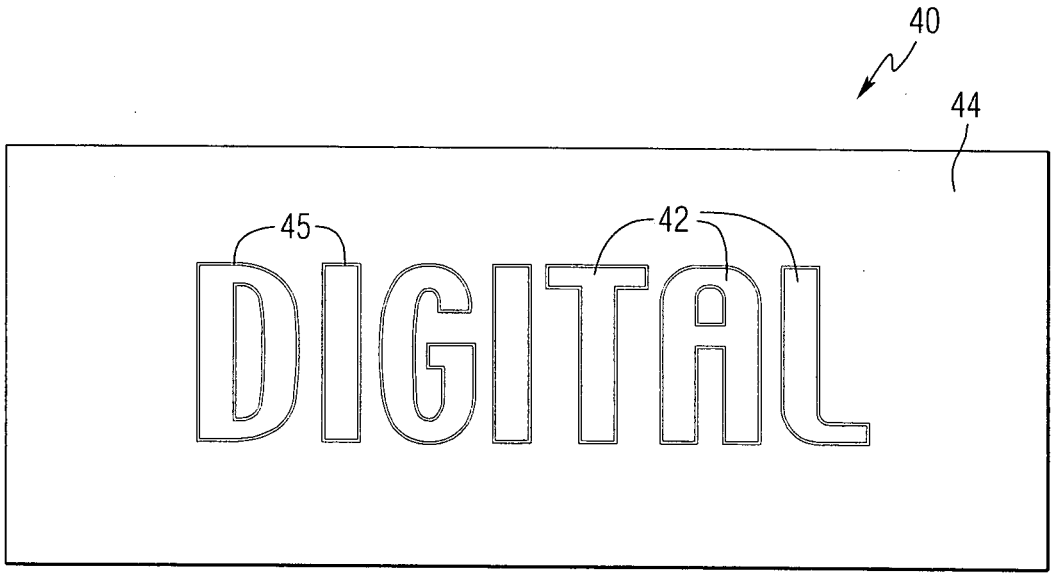
FIG. 7 is a front plan view of a second preferred embodiment of a sign in accordance with the present invention.
Figure 8:
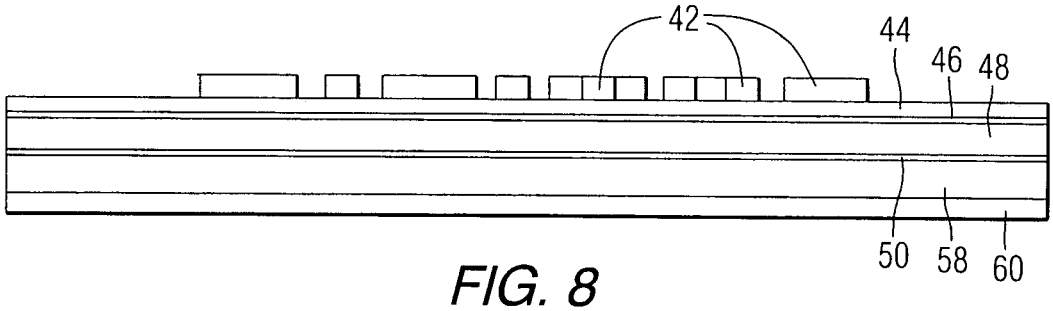
FIG. 8 is a side plan view of the sign of FIG. 7.

As shown in FIG. 6, each of the cavities 19 in the diffusion layer 18 may be shaped to alter the light dispersion angle $\acute{\alpha}$ at which the light from the light emitting member 23 enters the diffusion layer 18. Alternatively, the light dispersion angle $\acute{\alpha}$ may dependent upon the construction or design of the lens of each light emitting member 23. In either case, the light dispersion angle & preferably varies from 30° to 180°, and more preferably from 70° to 120°. Generally, fewer light emitting members 23 are required in the light diffusion layer 18 as the value of light dispersion angle $\acute{\alpha}$ is increased. For example, in display device of the present invention having a diffusion layer 18 ¼" thick and a light dispersion angle $\acute{\alpha}$ of 120°, square-bodied LEDs comprising the light emitting members 23 are preferably inserted into the cavities 19 at a depth of just under $\frac{1}{8}^{th}$ of an inch. If elliptical LEDs having a light dispersion angle $\acute{\alpha}$ of 70° are employed in this example, they preferably would be inserted to a depth of about $\frac{1}{4}^{th}$ of an inch. While the light emitting members 23 preferably do not come into contact with the masking layer 14, the cavities 19 may run all the way through the diffusion layer 18 in certain circumstances.

Figure 11:
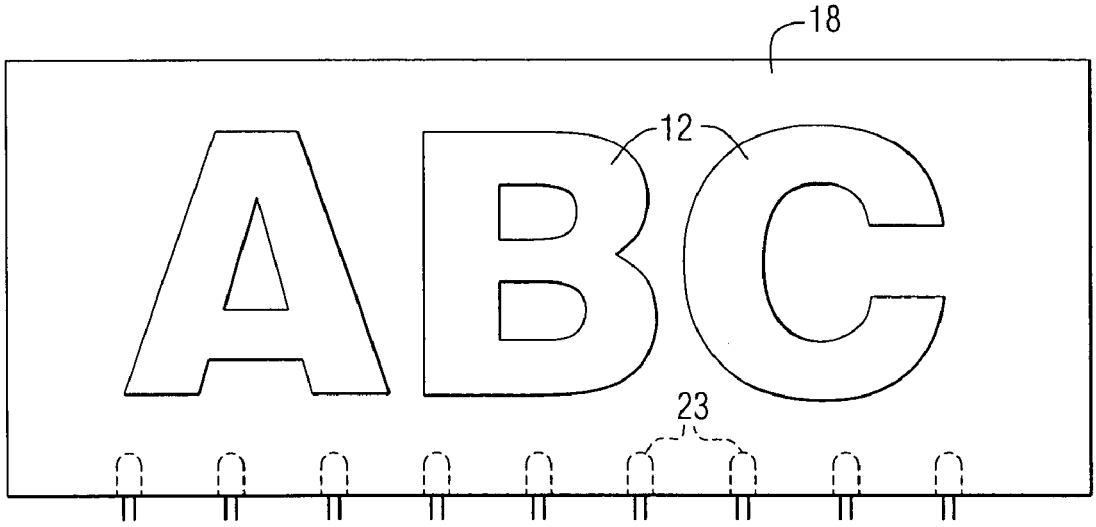
FIG. 11 is a plan view showing an alternate arrangement of the light emitting members in the light diffusion layer of the sign of the present invention.

The directionality of light emitting members 23 may be varied in accordance with the present invention. Depending on the size and layout of the indicia to be illuminated, the light emitting members 23 could be mounted vertically into the light diffusion layer 18 (as shown in FIGS. 3 and 4) with the beams of light therefrom directed toward the front face of the sign 10. In such case, the longitudinal axis of each cavity 19 is oriented substantially perpendicular to the front and back faces of the light diffusion layer 18. Alternatively, light emitting members 23 could be mounted along the side of the light diffusion layer 18 with the beams of light therefrom directed toward the center of the light diffusion layer 18, as shown in FIG. 11. In such case, the longitudinal axis of each cavity 19 is oriented substantially parallel to the front and back faces of the light diffusion layer 18. Further, the light emitting members 23 could be mounted in or along the side of the light diffusion layer 18 at any desired angle between vertical (perpendicular to the face of the light diffusion layer 18) and horizontal (parallel to the face of the light diffusion layer 18). In any case, the light emitting members 23 preferably may also be disposed adjacent to, and not within any cavity in, the diffusion layer 18.

When received in cavities 19, the light emitting members 23 are preferably disposed at a depth from about $\frac{1}{32}^{nd}$ to about $\frac{1}{4}^{th}$ of an inch into the light diffusion layer 18.

Preferably, the light emitting members 23 do not come into contact with the masking layer 14 to further minimize the localized concentration of light or "hot spotting" in the immediate vicinity of each light emitting member 23. The placement depth of the light emitting members 23 in the light diffusion layer 18, however, may vary with the light dispersion angle $\acute{\alpha}$ (FIG. 6) and brightness of the light emitting members 23 used.

The preferred spacing of light emitting members 23 also depends upon the light dispersion angle $\acute{\alpha}$, and the brightness and luminance of the light emitting members 23. In general, the preferred spacing between light emitting members 23 is from ¼" apart up to 2" apart. Typically, where the light dispersion angle $\acute{\alpha}$ is 70° or greater, the spacing would range from ¾ of an inch apart to 1¼ inches apart.

Masking Layer

While the characters 12 could preferably be painted, laminated or silk-screened onto the light diffusion layer 18, it is more preferable to add dimension to the characters 12 by making them out of an opaque material such as plastic, vinyl, paper, rigid foam, wood, other conventional signage materials or a combination thereof having a thickness ranging from about $1/64^{th}$ of an inch up to as thick as is desired or practical. Such preferred construction of the mask layer 14 operates to reduce hot spots around each of the light emitting members 23 and further increases the surface area for producing the desired glowing effect. The characters and/or symbols making up the masking layer 14 may be either permanently or temporarily affixed to the diffusion layer 18.

The masking layer 14 in combination with the reflective layer 16, has the qualities of both opacity and reflectiveness. The reflective layer 16 may be created by use of print ink, silk screen paint, foil, vinyl, metallic coatings and the like. One example of material that can be used is polyvinylchloride adhesive foil which is commercially available in many colors. Thus, the foil already has a color base, is reflective and, at least one side, includes an adhesive coating in the color of the material.

Preferably, the masking layer 14 masks the light emitting members 23 from direct view of an observer of the sign 10. Some light rays from the light emitting members 23 will reflect from the reflective surface of the reflective layer 16 back to the reflective layer 20 and thence forward to the viewer to form an aura around the character 12.

The preferred dimensional parameters of the masking layer 14 are where each portion thereof is a minimum of ¼ inch wide but more preferably ½ to ¾ inches wide to eliminate hot spotting of the light emitting members 23. The masking layer 14 is preferably completely opaque.

In accordance with this invention, the outer dimensions of the masking layer 14 of each character 12 may be larger than the diffusion layer 18, but are preferably smaller or the same size as those of the diffusion layer 18. The light rays passing from the light emitting members 23 through the diffusion layer 18 will still form an outline around the masking layer 14 unless the dimensions of the masking layer 14 are larger than those of the diffusion layer 18 to effectively eliminate the outline, albeit not the aura. The outline characteristic and three dimensional neon-like aura, however, will be most effective when the dimensions of the mask layer 14 are equal to or less than those of the diffusion layer 18.

Light Diffusion Layer

The light diffusion layer 18 preferably comprises an acrylic or plastic translucent or frosted material having a specific opacity that is not too opaque as to unduly diminish the travel of light therein and which is not too transparent so as to lead to the loss of the desired glowing effect and increased hot spotting around the light emitting members 23. Preferably, the light transmission rate of the diffusion layer 18 will be between 10% and 85% and most preferably it will be about 25%. Moreover, the light diffusion layer 18 preferably should be at least about ⅛ to ¼ of an inch in thickness, and may be thicker as required.

The light diffusion layer 18 may be comprise a layer of material having the top and/or bottom thereof frosted to create the desired translucent quality. Alternatively, the light diffusion layer 18 may comprise small particles, such as a powder of either a reflective or non-reflective nature, dispersed throughout an acrylic or plastic matrix material.

The light diffusion layer 18 may also comprise, at least in part, a fluorescent material. Further, the light diffusion layer 18 may comprise a milky white translucent material only, a fluorescent material only, or it may be a combination of such materials. Such fluorescent material may be applied to the diffusion layer 18 by such means as silk screen process using a fluorescent silk screen paint, a spray process using a fluorescent paint, a printing process using a fluorescent ink, or by even affixing a thin sheet of fluorescent plastic material thereto. The diffusion layer 18 may be selected in a color suitable to accomplish a desired effect on the completed sign in conjunction with the colors of the other layers 14, 16 and 20 of each character 12.

The primary purpose of the light diffusion layer 18 is to scatter or break up and distribute light generally uniformly from the light emitting members 23. Thus, the light from the light emitting members 23 will not be observed directly by the viewer, who preferably will only see uniformly transmitted light emanating from the diffusion layer 18 behind each character 12 in this first preferred embodiment. Lastly, the light diffusion layer 18 may comprise any form, shape and/or dimension, and is not limited to the shapes of the characters or symbols comprising the masking layer 14.

Figure 9:
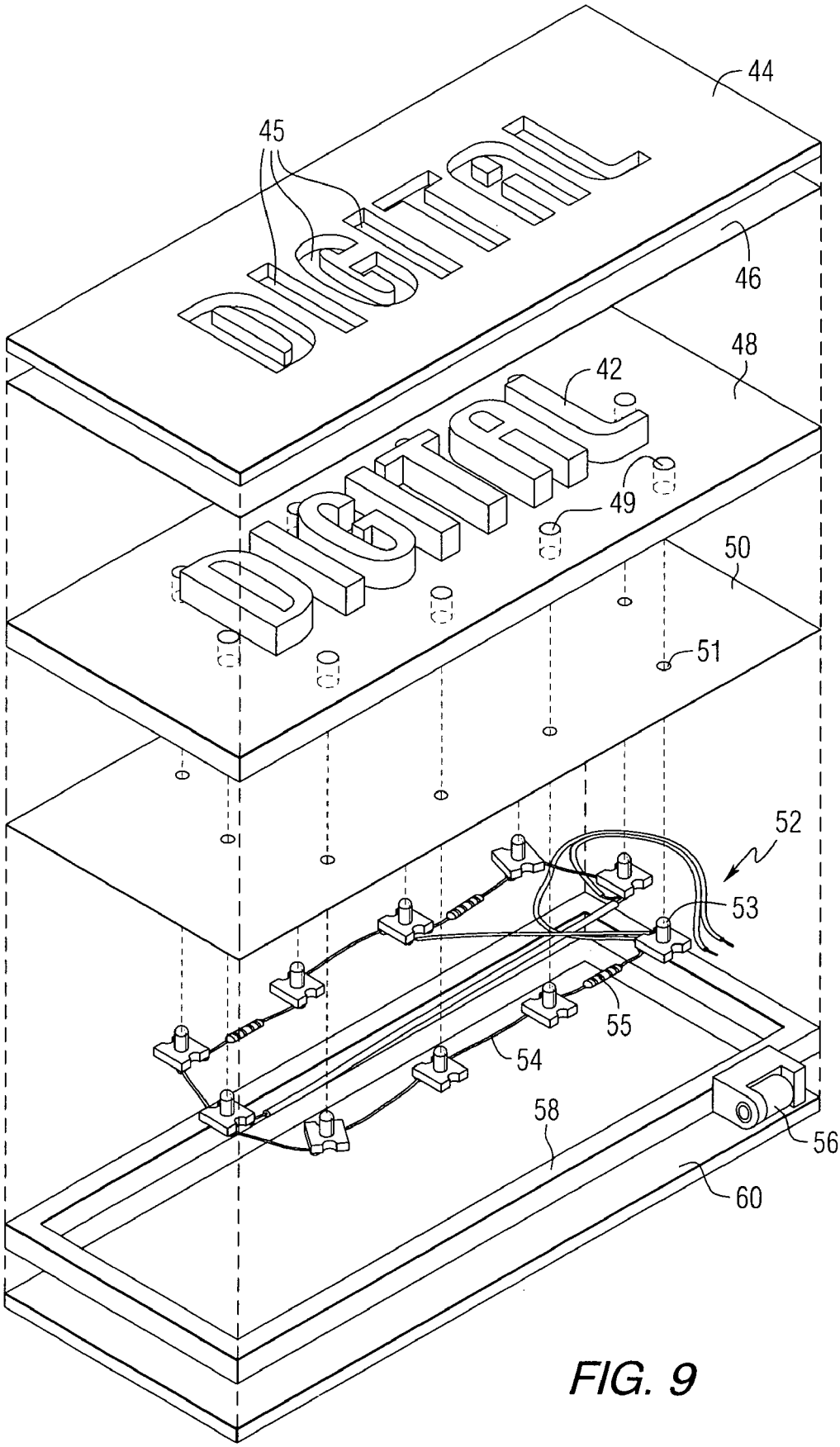
FIG. 9 is an exploded perspective view of the sign of FIG. 7.
Figure 10:
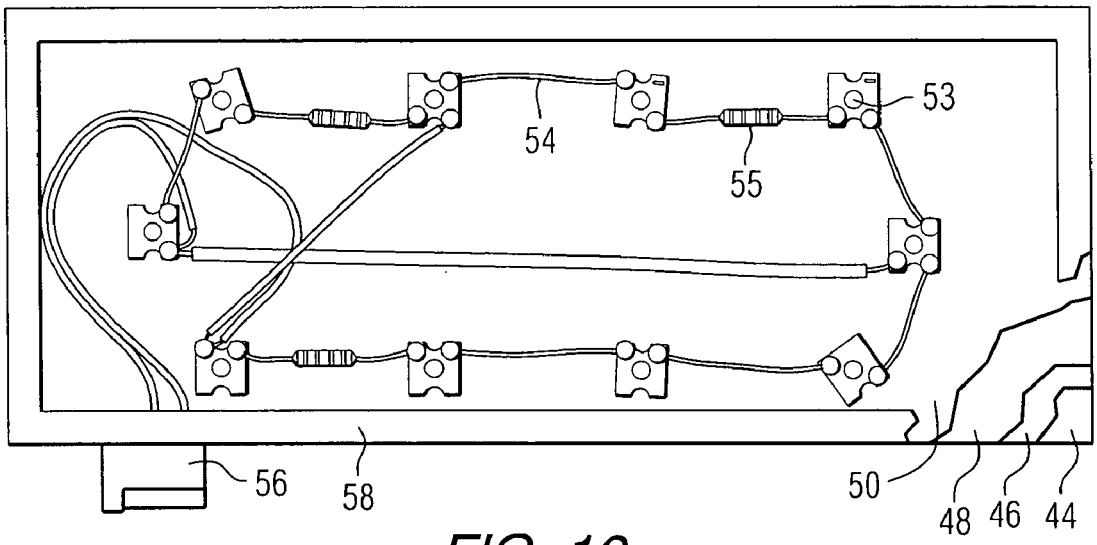
FIG. 10 is a rear plan view of the sign of FIG. 7 with the back cover removed and having a portion cut away.

FIGS. 7–10 illustrate a second preferred embodiment of a sign 40 of the present invention. The sign 40 comprises a plurality of characters/symbols 42, in this case being the letters spelling out the word "DIGITAL". As shown in FIG. 9, each of the characters 42 is preferably formed in raised relief as part of the diffusion layer 48. In this preferred embodiment, the masking layer 44 defines openings 45 corresponding to the characters 42. When assembled, the characters 42 are received in and protrude through the openings 45 in the masking layer 44. Otherwise, the light diffusion layer 48, cavities 49, reflective layers 46 and 50 (defining openings 51) are the same or very similar to the corresponding components of the sign 10 of first preferred embodiment described above. Here again, the masking layer 44 may be either permanently or temporarily affixed to the diffusion layer 48.

The means for lighting 52 of the sign 40 of the second preferred embodiment may comprise any of the devices discussed above with respect to the first preferred embodiment of the present invention, including a circuit of a plurality of light emitting members 53 connected by wires 54 and resistors 55, where required. A power source connector/battery 56 is preferably attached to the frame member 58. Here again, the light dispersion angle $\acute{\alpha}$ for each of the light emitting members 53 preferably varies from 30° to 180°. Generally, fewer light emitting members 53 are required in the light diffusion layer 48 as the light dispersion angle (see FIG. 6) and/or the luminance of each light emitting member 53 increases. The means for lighting 52 is protected from the elements by the frame member 58 and back cover 60.

The displays and signs of the present invention may include graphics and logos as small as ⅛$^{th}$ of an inch in height and width, and as thin as ½" and still produce the even glow and brightness of neon signs. As such, the present invention is very useful in the production of illuminated name badges and for illuminating original works such as logos alone or in combination with other conventional signs, or even in combination with products.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered by way of example only to facilitate comprehension of the invention and should not be construed to limit the scope thereof.

What is claimed is:

1. A sign comprising:

a light diffusion layer having front and back faces;

means for lighting disposed on or in close proximity to said light diffusion layer;

a masking layer covering at least a portion of the front face of the light diffusion layer and defining at least one character or symbol of said sign; and a reflective layer disposed between the front face of the diffusion layer and a rear face of the masking layer, wherein said reflective layer covers at least a portion of the front face of the diffusion layer.

2. A sign comprising:

a light diffusion layer having front and back faces;

means for lighting disposed on or in close proximity to said light diffusion layer;

a masking layer covering at least a portion of the front face of the light diffusion layer and defining at least one character or symbol of said sign;

a first reflective layer disposed between the front face of the diffusion layer and a rear face of the masking layer, wherein said first reflective layer covers at least a portion of the front face of the diffusion layer; and a second reflective layer covering at least a portion of the back face of the diffusion layer.

3. A sign having at least one character or symbol wherein each character or symbol comprises:

a light diffusion layer having front and back faces, wherein said light diffusion layer defines a plurality of cavities;

a plurality of light emitting members wherein each light emitting member is at least partially disposed within one of said plurality of cavities; and a masking layer covering at least a portion of the front face of the light diffusion layer.

4. The sign of claim 3 further comprising a reflective layer disposed between the front face of the diffusion layer and a rear face of the masking layer, wherein said reflective layer covers at least a portion of the front face of the diffusion layer.

5. The sign of claim 3 further comprising a reflective layer covering at least a portion of the back face of the diffusion layer.

6. The sign of claim 3 further comprising:

a first reflective layer disposed between the front face of the diffusion layer and a rear face of the masking layer, wherein said first reflective layer covers at least a portion of the front face of the diffusion layer; and a second reflective layer covering at least a portion of the back face of the diffusion layer.

7. The sign of claim 3 wherein a light dispersion angle of each light emitting member ranges from about 30° to about 180°.

8. The sign of claim 3 wherein a light dispersion angle of each light emitting member ranges from about 70° to about 120°.

9. The sign of claim 3 wherein a longitudinal axis of each cavity is oriented substantially perpendicular to the back face of the light diffusion layer.

10. The sign of claim 3 wherein a longitudinal axis of each cavity is oriented substantially parallel to the back face of the light diffusion layer.

11. The sign of claim 3 wherein the diffusion layer forms a border around at least a portion of a perimeter of said masking layer.

12. The sign of claim 3 wherein said masking layer has substantially the same shape as the diffusion layer but of smaller dimensions so that the diffusion layer forms a border around substantially the entire perimeter of said masking layer.

13. The sign of claim 12 wherein said border is of a uniform width.

14. The sign of claim 12 wherein said border is not of a uniform width.

15. The sign of claim 3 wherein each light emitting member comprises a light emitting diode.

16. The sign of claim 3 wherein said light diffusion layer comprises, at least in part, an acrylic material.

17. The sign of claim 3 wherein said light diffusion layer comprises an acrylic matrix material having particles dispersed therein.

18. The sign of claim 17 wherein said particles reflect light.

19. The sign of claim 3 wherein said light diffusion layer comprises, at least in part, a fluorescent material.

20. The sign of claim 3 further comprising a battery for supplying electrical power to each light emitting member.

21. The sign of claim 20 further comprising means for donning said sign.

22. A sign having at least one character or symbol wherein each character or symbol comprises:

a light diffusion layer having front and back faces, wherein said light diffusion layer defines a plurality of cavities and a longitudinal axis of each cavity is oriented substantially perpendicular to the back face of the light diffusion layer;

a plurality of light emitting members wherein each light emitting member is at least partially disposed within one of said plurality of cavities;

an opaque masking layer covering at least a portion of the front face of the light diffusion layer;

a first reflective layer disposed between the front face of the diffusion layer and a rear face of the opaque masking layer, wherein said first reflective layer covers at least a portion of the front face of the diffusion layer; and a second reflective layer covering at least a portion of the back face of the diffusion layer.

* * * * *